US006149549A

United States Patent [19]

Login et al.

[11] Patent Number: 6,149,549

[45] Date of Patent: Nov. 21, 2000

[54] ANIONICALLY DERIVATISED COTTON FOR IMPROVED COMFORT AND CARE-FREE LAUNDERING

[75] Inventors: Robert B. Login, Simpsonville; Otto Bella, Tryon; Calvin McIntosh Wicker, Jr., Spartanburg, all of S.C.

[73] Assignee: Syborn Chemicals, Inc., Wellford, S.C.

[21] Appl. No.: 09/157,643

[22] Filed: Sep. 21, 1998

[51] Int. Cl.[7] ..... D06M 11/66; D06M 13/184; D06M 13/325; D06P 5/22; D06P 3/86

[52] U.S. Cl. ..... 481/8; 8/116.1; 8/127.1; 8/181; 8/188; 8/194; 8/195; 8/196; 8/494; 8/585; 8/592; 8/929

[58] Field of Search ..... 8/116.1, 120, 127.1, 8/181, 188, 194, 195, 196, 481, 585, 494, 929, 592

[56] References Cited

U.S. PATENT DOCUMENTS

| | | |
|---|---|---|
| 2,511,229 | 6/1950 | Thomas . |
| 2,681,846 | 6/1954 | Guthrie et al. . |
| 2,726,133 | 12/1955 | Heifenberger et al. . |
| 2,935,471 | 3/1960 | Aarons et al. . |
| 3,674,418 | 7/1972 | Lyons et al. . |
| 4,181,498 | 1/1980 | Koltai et al. . |
| 5,478,489 | 12/1995 | Abdennaceur et al. . |
| 5,490,865 | 2/1996 | Scheiwiller . |

FOREIGN PATENT DOCUMENTS

| | | |
|---|---|---|
| 145884 | 1/1979 | India . |
| 147522 | 3/1980 | India . |
| 49013499 | 2/1974 | Japan . |
| 4933718 | 9/1974 | Japan . |
| 53143786 | 12/1978 | Japan . |
| 5502688 | 6/1980 | Japan . |
| 55082688 | 6/1980 | Japan . |
| 60151373 | 8/1985 | Japan . |

OTHER PUBLICATIONS

"Flame–Resistant Cellulose Esters", by P. Isaacs et al., Textile Research Journal, Sep. 1974.

"Sulfonation and Related Reactions", by Everett E. Gilbert, Interscience Monographs on Chemistry, Inorganic Chemistry Section, pp. 24–25, 258–261, 268–269, 272–273, 276–277, 282–283, 300–301, 354–361, 506–507 (1965).

"Dyeing and Mechanical Properties of Cotton Modified for Cationic Dyes with Hydrophobic and Acidic Groups", by Kazuhiko Fukatsu, Textile Research Journal, Mar. 1992, pp. 135–139.

"Differential Dyeing Cotton. 1–Preparation and Evaluation of Differential Dyeing Cotton Yarn", by Jacqueline A, Clipson et al. JSDC, vol. 105, pp. 159–162, Apr. 1989.

"N–Methylol–2–Pyrrolidone–5–Carboxylic Acid, A Convenient Compound for Incorporating a Carboxyl Group Onto Cellulose", Letter by John D. Turner, Textile Research Journal, Apr. 1975, pp. 354–355.

"Pad–Bake Reactions, Part I: A New Pad–Bake Reaction of Cellulose and Aqueous Solutions of Amic Acids", by J.A. Cuculo, Textile Research Journal, Apr. 1971, pp. 321–326.

"Pad–Bake Reactions, Part II: A New Pad–Bake Reaction of Cellulose and Aqeous Solutions of Anhydride–Ammonia", by J.A. Cuculo, Textile Research Journal, May 1971, pp. 375–378.

"Heat Transfer in Products of Emulsion Polymerization", by Matejicek, et al., Chem. Prum., 1980, pp. 116–121.

"Reactions of Wool with Sulfamic Acid", by B.A. Cameron et al., Textile Research Journal, Nov. 1987, pp. 619–624.

"Dyeing Properties of Sulphamic Acid–Treated Wool", by B.A. Cameron et al., JSDC vol. 103, Jul./Aug. 1987, pp. 257–260.

"Chemical Treatments Designed to Modify the Affinity of Wool for Dyes", by V.A. Bell, JSDC vol. 100, Jul./Aug. 1984, pp. 220–230.

Lewin, Menachem Flame retarding of Polymers with sulfamates Part I. Sulfation of Cotton & Wool J. Fire Sci, 15(4) pp. 263–276 (abstract), 1997.

Doshi, S. M. "Use of Sulfamic acid or its ammonuim salt as catalyst in wrinkle resistant finishing of cotton textiles" Colourage 26(23) p. 25–34 abstract, 1979.

*Primary Examiner*—Margaret Einsmann
*Attorney, Agent, or Firm*—Dority & Manning, P.A.

[57] ABSTRACT

The present invention is generally directed to a process for making fabrics containing cotton fibers more aesthetically pleasing and resistant to staining by anionic dyes by derivatising the cotton so that it exhibits a permanent anionic charge. By increasing the anionic charge of the fibers, the fibers become resistant to anionic coloring agents which may undesirably come into contact with the fibers. Furthermore, the negative charges repel each other resulting in a fabric with greater loft and porosity. This results in greater smoothness, better hand, and more comfort. Besides being used to prevent the cross-staining of fabrics, the present invention can also be used to make carpet materials resistant to anionic staining agents. Alternatively, it has also been discovered that an anionic derivative can be used to catalyze permanent press resins onto fabrics containing cellulosic fibers, also resulting in anionic cotton.

38 Claims, No Drawings

ANIONICALLY DERIVATISED COTTON FOR IMPROVED COMFORT AND CARE-FREE LAUNDERING

FIELD OF THE INVENTION

In general, the present invention is directed to a process for improving cotton fibers and textile products containing cotton fibers by, for example, making them resistant to cross-staining. In particular, the present invention is directed to an anionic treatment process for cotton fibers that makes the fibers repel anionically-charged dyes and auxiliaries or attract cationically charged dyes and auxiliaries. In a particular embodiment, the present invention is further directed to a process for curing permanent press resins applied to textiles that also makes the textiles stain resistant.

BACKGROUND OF THE INVENTION

The problem of cross-staining between cotton fabrics during laundering and processing is a significant household and textile problem. Cross-staining relates to the transferring of dye that may occur between fabrics under either wet or dry conditions while fabrics are being manufactured, processed or laundered. Television commercials are aired daily for expensive detergents meant to minimize cross-staining. In fact, much advertising and product manufacturing are devoted to this common annoyance. The detergents that advertise colorfastness are designed to approach the problem of cross-staining through the use of dye antiredeposition agents that are incorporated into their formulas. These antiredeposition agents, however, add expense to the detergents and are not fully effective in preventing cross-staining. Thus, a method of preventing dye transfer without relying on the use of detergents would prove to be both practical and economical.

The dye transfer between cellulosic fabrics, such as cotton fabrics, occurs when fabrics are laundered or processed in the same bath. Dye transfer occurs because cellulosic fibers have a mild attraction for anionic classes of dyes, which are the majority of the dyes now employed to dye cotton and other cellulosic fabrics and blends. Dyes are made to be anionic or negatively charged so that they will benefit from water solubility. Such classes of dyes include reactives, directs, acids, and the like. A primary example of this dye transfer is the staining of the white pockets in blue jeans during garment manufacture and during laundering. The anionic leuco form of the indigo dyes in the blue jeans are absorbed by the undyed cotton fibers in the pockets because of their chemical attraction to one another.

An even more well-known example is the transfer of dyes between dark-colored garments and white or light-colored garments during the laundering process. The loosely-held anionic dyes in the fibers of the dark-colored garments stain the white or light-colored garments. This dye transfer may adversely affect white or light-colored garments. Similarly, striped or patterned garments containing both dark-colored fabric and white or light-colored fabric may experience bleeding of the dark-colored dyes on to the lighter portions because of the attraction of unfixed anionic dyes to the cellulosic fibers in the white or light-colored portions. Therefore, it is evident that weakening this attraction between the anionic dyes and the cotton fibers would provide a solution to the problem of dye transfer.

A need currently exists for a solution to the problem of dye transfer regarding cellulosic fabrics so that the needs for expensive detergents and other methods of colorfastness are eliminated. In particular, a need exists for a process that treats cellulosic fibers in order to permanently increase their anionic character so that these fibers are able to resist anionic dyes that cross stain fabrics. The present invention is directed to a process that meets the above described need.

SUMMARY OF THE INVENTION

The present invention recognizes and addresses the foregoing disadvantages and drawbacks of prior art constructions. Accordingly, it is an object of the present invention to provide a process for making cellulosic fibers, such as cotton fibers, and textile products made from the fibers anionic, resistant to cross-staining, and improved as far as hand, appearance, and comfort.

Another object of the present invention is to provide a process for making cotton fibers resistant to cross-staining through a permanent anionic treatment.

Another object of the present invention is to provide a process that not only makes cotton fibers resistant to cross-staining, but also provides the fibers with a greater attraction to cationic fabric softeners and bacteriocides.

Still another object of the present invention is to provide a process for treating cotton fibers or textiles containing cotton fibers with a sulfamate, which increases the anionic charge of the material.

Another object of the present invention is to treat cotton fibers, or textiles made from the fibers, with a composition containing ammonium sulfamate and urea, which makes the material resistant to cross-staining.

It is another object of the present invention to provide a process for curing permanent press resins using a magnesium sulfamate as a catalyst.

These and other objects of the present invention are achieved by providing a process for making fabrics containing cellulosic fibers, particularly cotton fibers, resistant to cross-staining. More particularly, the fabrics become resistant to being stained by anionic coloring agents that may undesirably contact the fabric during the manufacture of the fabric or during laundering or some other aqueous process. Furthermore, fibers used in cotton carpeting become resistant to being stained by accidental spillage.

The process includes the steps of providing a fabric containing cotton fibers. The fabric can be pre-dyed and/or can be in a substantially finished state. The fabric is contacted with a solution containing a derivatising agent. For instance, the agent can be a reaction product of a volatile amine and sulfamic acid. The volatile amine can be ethyl amine, methyl amine, ammonia, or mixtures thereof.

Once contacted with a derivatising agent, the fabric is heated to a temperature sufficient for the agent to react with the cellulosic fibers contained within the fabric. Through this reaction, the anionic charge of the cellulosic fibers is increased for making the fibers more resistant to anionic coloring agents during casual contact.

Although the combination of ammonium sulfamate and urea will sulfate cotton to form the ammonium sulfate ester, it is but one of several methods according to the present invention of permanently rendering cotton anionic in charge. It is the anionic charge and not the reagents or structure of the anionic derivative that matters, but the negative (anionic) charge itself that is the means of achieving the benefits of this invention.

For most applications, the process of the present invention is used to protect predyed and preformed fabrics from staining during consumer laundering. It should be understood, however, that the process of the present invention can also be used to treat fibers themselves prior to being formed into a fabric or garment.

As described above, in one embodiment, the sulfating agent is a reaction product of a volatile amine and sulfamic acid. In this embodiment, the sulfating agent can be contained in an aqueous solution when applied to the fabric or fibers. Preferably, an amide of a carboxylic acid, such as urea, can also be included within the aqueous solution. Urea is not only believed to act as a catalyst, but also protects the fabric from yellowing and from being damaged by heat during sulfation.

In one embodiment, the sulfating solution includes ammonium sulfamate in a concentration of at least 5 grams per liter, and particularly in an amount from about 10 grams per liter to about 40 grams per liter. Urea can be present in the aqueous solution in an amount of at least 25 grams per liter, and particularly in an amount from about 25 grams per liter to about 100 grams per liter. In this embodiment, during curing and sulfation, the fabric can be heated to a temperature of from about 280° F. to about 325° F. However, if flash curing is required, much higher temperatures such as 400° F.–425° F. can be considered.

Prior to sulfation, the fabric or fibers are dried in order to remove substantially all of any moisture present on the fibers. For example, in one embodiment, the fabric can be dried at a temperature of from about 150° F. to about 200° F. prior to sulfation.

It should be understood, however, that other concentrations, parameters, and reagents can be employed to render cellulosics, such as cotton, anionic. Other reagents include $SO_3$, $P_2O_5$, sodium chloroacetate, 115% polyphosphoric acid, maleic anhydride, the reaction product of epichlorohydrin and sodium sulfite or bisulfite, vinyl sulfonate, the condensate of DMDHEU and sulfite, etc.

Besides preventing cross-staining, it has been discovered that negatively charged cotton is also able to attract positively charged auxiliaries such as basic dyes. When sufficient negative charge is affixed to cotton, significant levels of basic dyes will readily exhaust.

Negatively charged cotton or more simply anionic cotton will also attract significant amounts of cationic softeners such as fatty quaternaries and amino siloxanes. The level of negative charge will control the amount exhausted. Therefore, by controlling the level of anionic charge, one can control the degree of softener and hence softness of the garment. The ability to achieve maximum softness at low temperatures and very short exhaust cycles (3–5 minutes) has never been achieved prior to this invention.

Cationic biocides can also be exhausted at higher levels than typically achieved on untreated cotton and at levels where more significant efficiency can be achieved.

Anionic cotton will afford garments with greater loft and better smoothing properties (anti-wrinkling). This is because of charge repulsion. With anionic groups, charge repulsion can be a significant force pushing the like charges to repel each other and achieving a farthest separation possible between the fibers resulting in a smoother fabric. Fibrils in the yarns are also repelled from each other and this results in greater loft or bulk.

For these reasons, anionic cotton has a better feel (hand) than untreated fabric even without softeners. This is because the fibrils and yarns are more uniform and bulkier affording a smoother more desirable surface that can be felt and appreciated by the consumer. This is especially evident in loosely constructed fabrics.

The process of the present invention can also be used to treat carpet materials to make them resistant to staining by anionic agents. For instance, carpet materials containing cellulosic fibers, such as cotton fibers, can be sulfated as described above.

In still another embodiment of the present invention, it has been discovered that a metal sulfamate can act as a catalyst for permanent press resins. Of particular advantage, the metal sulfamate not only assists in curing permanent press resins on fabrics, but also enhances the stain resistance of the fabric to anionic coloring agents.

In this regard, the present invention is also directed to a process for curing a permanent press resin on a fabric. The process includes the step of contacting a fabric containing cellulosic fibers with a permanent press resin and a catalyst. The catalyst is a metal sulfamate, such as magnesium sulfamate. The permanent press resin can be, for instance, dimethyl dihydroxy ethylene urea.

Once contacted with the permanent press resin and catalyst, the fabric is heated to a temperature sufficient to cure the permanent press resin onto the fabric.

Other features of anionic cotton produced according to the present invention are that fabrics made from the cotton have enhanced wrinkle recovery caused by the negative charge repulsion electrostatic effect. For instance, it has been discovered that cotton treated with excess sodium chloroacetate allowed to dry in a smooth wrinkle free state will reoriented itself when redried in a tension free environment. In this case, we believe that the negative charges on the cotton repel each other and prefer to orientate back to the most favored positions, which results in smoothing.

For the same reason, the fibrils that make up the yarns when treated repel each other in the resulting fabric increasing loft and resulting in a more open construction that exhibits a more acceptable hand (feel) and transports moisture more easily resulting in greater comfort.

Other objects, features, and aspects of the present invention are discussed in greater detail below.

DETAILED DESCRIPTION OF PREFERRED EMBODIMENTS

The present invention is generally directed to a process which permanently increases the anionic charge of cellulosic fibers, particularly cotton fibers, so that the treated fibers resist being cross stained by anionic dyes. As used herein, derivatising cellulosic fibers refers to a process by which the anionic charge of a cellulosic material becomes permanently increased through the formation of a chemical bond, such as a covalent bond, between the cellulosic material and a derivative, which can be a negatively charged ion. When derivatising cotton fibers according to the present invention, an ester linkage is formed between the derivative and the cotton material.

The anionic treatment process of the present invention is generally accomplished by derivatising the cellulosic fibers in a manner that increases the negative charge of the fibers an amount sufficient for the fibers to repel anionically charged dyes. The treated cellulosic fibers and fabrics made in accordance with the present invention become resistant to cross-staining during laundering or other process treatments. When this occurs, the resulting garment exhibits improved properties such as smoothing, being wrinkle-free, greater loft, and improved moisture transport.

The invention described herein introduces a method in which colorfastness and dye transfer resistance become objectives for the manufacturers of cellulosic fabrics and no longer serve as objectives for the manufacturers of expensive detergents. The scope of the present invention encompasses a widely known household problem and brings about a practical solution to this problem. Resolving this problem is also an indicator of the other previously mentioned benefits.

The present invention has multiple applications that reward both consumers and manufacturers with many advantages. The process of anionically treating the cellulosic fibers in white or light-colored fabrics prevents the fabrics from being cross stained while in the same bath with dark-colored fabrics. The treatment process also impedes the ability of colors on the same garment to bleed into one another. Similarly, by treating fibers to have an increased anionic charge, the fibers will resist cross-staining while they are being manufactured and heavily processed. The other benefits including comfort, appearance, and aesthetic improvements are difficult to quantify, but are nonetheless important to the present invention.

In one particular application, the white pocket fibers and the undyed fill yarn in denim garments may be treated in accordance with the present invention so that they are not stained by indigo dyes or other dark dyes present in the garments. As discussed above, in the past, garment manufacturers have had problems in keeping pocket liners white for the life of the garment, since such liners are typically made from undyed cotton fibers and blends which are easily cross stained. By treating pocket liners in accordance with the present invention, the pockets of a garment remain white even after repeated launderings, which greatly enhances the visual appeal of the garments.

The process of anionically treating cellulosic fibers in accordance with the present invention may also be applied to fibers and yarns used in carpeting. In particular, the process of the present invention is particularly well-suited for use with carpet materials made with cotton fibers. The treatment renders the carpet fibers extremely stain resistant to anionic compounds, dyes, and other coloring or staining agents. Charge repulsion results in greater loft and hence coverage.

Besides increasing the stain resistance of textile products containing cellulosic fibers, such as cotton fibers, the process of the present invention also produces other advantages. For instance, once treated in accordance with the present invention, garments have an increased attraction to cationic fabric softeners and bacteriocides, which may be used to treat the garments either during manufacturing or during regular laundering in the rinse cycle or in the dryer. Specifically, most fabric softeners and bacteriocides are cationically charged. Thus, by increasing the anionic character of fibers present in garments, a greater attraction is produced between the garments and the fabric softeners and bacteriocides. The levels of these ingredients can be controlled at higher levels.

As described above, the present invention is generally directed to a process for increasing the anionic character of cellulosic fibers in order to prevent cross-staining. Many different processes can be used to increase the anionic character of cellulosic fibers in accordance with the present invention. In the past, others have proposed various methods for increasing the anionic charge of cellulosic materials. As opposed to the present invention, however, these processes were not used for preventing cross-staining, but, instead, were used for other purposes.

In one embodiment of the present invention, the anionic character of cellulosic fibers is increased through a sulfation or sulfonation process. A variety of reagents are suitable for use in these processes.

For instance, sulfamic acid, a reagent normally found in powder form, can be used to achieve sulfation of cellulosic fibers. However, the use of sulfamic acid may lead to hydrolysis and yellowing of the fabric. Consequently, a neutral pH sulfamate is initially contacted with the fabric or fibers in order to protect the fabric or fibers from hydrolysis and yellowing. For example, in one embodiment of the present invention, the reaction product of sulfamic acid and a volatile amine is used. Thus far, such a reaction product has proved to be an effective and inexpensive sulfating agent for cellulosic fibers such as cotton fibers.

As used herein, a volatile amine refers to an amine that will evaporate when the fabric is later cured. Examples of volatile amines that may be used in the present invention include methyl amine, ethyl amine, ammonia, and the like including mixtures of the above as well.

In one embodiment, ammonium sulfamate is used. The ammonium ion easily reverts to volatile ammonia when heated. Thus, the sulfating agent sulfamic acid is regenerated under mild conditions of minimal acidity.

In one embodiment of the present invention, when treating fibers and fabrics, the reaction product of sulfamic acid and a volatile amine can be added to an aqueous solution at a concentration of at least 20 grams per liter. For instance, in one embodiment, ammonium sulfamate is added to an aqueous solution at a concentration of 5–40 g/L and particularly at a concentration of 10–20 g/L. The concentration of course depends on the wet pick-up during application. Thus far, it has been found that adding over 40 g/L of the ammonium sulfamate to the aqueous solution adds no further benefit to the anionic treatment of the cellulosic fibers. In fact, the addition of too much ammonium sulfamate to the solution may start to induce excessive yellowing of the fibers and weaken the fibers.

In order for the above stated sulfation process to occur properly and to enable the cellulosic fibers to be anionically treated for resistance to cross-staining, urea, which may act as a co-reactant, can be introduced into the aqueous solution being prepared for the treatment. In addition, adding urea prevents yellowing of the fibers and protects the fibers during heat treatment. Urea can be added at a concentration from about 25 g/L up to about 100 g/L. In one embodiment, urea is added to the aqueous solution at a concentration of 25–75 g/L. Thus far, it has been found that using over 100 g/L of urea adds no further benefits to the cellulosic fibers.

In general, a higher concentration of urea (50–75 g/L) should be used for certain cellulosic fibers such as 100% blended mercerized cotton fibers while a lower concentration of urea (30–50 g/L) can be used for other cellulosic fibers such as unmercerized cotton fibers.

Besides the derivatizing agent and urea, various other additives and ingredients may be included in the composition as desired. For instance, various additives can be included for either improving the process or for improving the final product. For example, in one embodiment, sodium borate ($Na_2B_4O_7$) can be added. In particular, it has been discovered that sodium borate in small amounts is beneficial in further preventing yellowing of the fibers. For instance, sodium borate can be added to the composition in an amount up to about 8 g/L, and particularly in an amount from about 2 g/L to about 3 g/L.

In another embodiment of the present invention, ammonium phosphate may be incorporated into the aqueous solution in addition to urea. This component can be added at a concentration of approximately 5 g/L to replace 25 g/L of urea and maintain the same performance. The purpose of adding the ammonium phosphate is to reduce the moisture pickup or the amount of water absorbed by the other reactants, especially urea. Thus, the properties of the ammonium phosphate counteract the hygroscopic properties of the urea, and therefore reduce moisture absorption if warranted.

However, it has been found that ammonium phosphate may lead to the formation of phosphoric acid which may adversely affect the strength of the cellulosic fibers. Thus, the use of ammonium phosphate is optional. Further, urea is preferred as a catalyst.

In another embodiment of the present invention, besides using a sulfamate, derivatising the cellulosic fibers is carried out by using the reaction product of epichlorohydrin and sodium bisulfite. The reaction product in this embodiment is a glycidyl sulfonate salt, which has the capability to act as a sulfonating agent unlike ammonium sulfamate which is a sulfating agent.

One embodiment of a process for derivatising cellulosic fibers, particularly cotton fibers, in accordance with the present invention will now be described. In the following embodiment, sulfation of the fibers is carried out using ammonium sulfamate in combination with urea. It should be understood, however, that various other sulfating or sulfonating agents may be used in accordance with the present invention in addition to other anionic modifying reagents and that the following description is for exemplary purposes only. In particular, it should be understood that the following concentration ranges and parameters can widely vary depending upon the particular application. For instance, such concentrations and parameters can change when treating carpet materials.

The process of anionically treating cellulosic fibers in order to render them resistant to cross-staining begins with adding the cellulosic fibers or fabrics to a solution bath. This aqueous solution bath can contain ammonium sulfamate and urea at concentrations of 5–20 g/L and 25–75 g/L respectively and can be at a temperature of from 60 to 90° F.

Well-prepared cellulosic fibers or fabrics are contacted or padded with the aqueous solution for a short time. Such fibers require only a brief period of contact with the aqueous solution because of the high wet pick-up values (50–80% weight). After the fibers are contacted with the aqueous solution bath, the excess water and solution are abstracted by squeezing out the fibers or fabric.

The fibers are then dried at a temperature of from 150–200° F. for 1–2 minutes. Next, the fibers are cured at a higher temperature (from 280–325° F.) in order for the sulfation reaction to go to completion. During this heat treatment, the ammonia is volatilized and given off. Also during heat treatment, the sulfate ions that were released from the ammonium sulfamate reaction become bound to the cellulosic fibers, increasing the anionic character of the fibers.

The heat curing process can typically last up to approximately 5–10 minutes. This depends on the fabric construction and weight and in some cases "flash curing" at 400° F.–425° F. is sufficient (which can last for only a few seconds). The fibers are then rinsed at a temperature of about 100° F. for 2 minutes and are neutralized with a sodium carbonate solution for 3–4 minutes. At the completion of this process, the anionic charge of the cellulosic fibers becomes permanently increased.

As described above, the process of the present invention permanently increases the anionic character of cellulosic fibers and fabrics in order to make textile articles resistant to cross-staining. For some applications, the fibers should be treated according to the present invention after a fabric or garment is formed, and preferably after the fabric or garment has been dyed. As such, the present invention can be viewed as a post-treatment process for post-treating formed fabrics and/or garments.

In alternative embodiments, however, the cotton fibers can be derivatised according to the present invention at other stages during the fabrication of the particular textile article. For most garments, such as shirts, blouses and the like, the anionic treatment takes place on the formed fabric before the fabric is cut and sewn into a particular item. In particular, preferably the fabric is treated after being dyed. For white garments, such as white shirts, the anionic treatment is carried out after the fabric has been bleached and treated with a colorless dye such as an optical brightener.

As stated above, the anionic treatment of the present invention is particularly designed for light or white colored fabrics, where cross-staining creates more of a potential problem. In fabrics and garments containing light colored areas and dark colored areas, such as striped or patterned fabrics, in one embodiment, the light colored areas can be treated according to the present invention by treating the yarn that is used to form those areas. Preferably the anionic treatment is carried out after the yarn has been dyed. For example, for denim fabrics and garments, preferably the white fill yarn is treated prior to being incorporated into the denim fabric. Alternatively, the fiber itself can be treated prior to being formed into the yarn.

Other garments that are particularly well suited for use in the process of the present invention include socks and other hosiery, pocket liners, and various undergarments. With respect to pocket liners, preferably the fabric that is used to make the pocket liners is treated prior to being incorporated into a garment. With respect to socks and undergarments, however, the yarn, the fabric or the completed product itself can be treated according to the present invention.

Besides fabrics and garments, however, the process can be used to treat fibers in other applications as well. For instance, as described above, the process of the present invention can be used to treat carpet materials, especially carpet materials containing cotton fibers, in order to increase the resistivity of the materials to staining by anionic agents, especially the red dye employed in the so-called cherry "Kool-Aid" stain blocking test. Further, it has also been discovered that treating the cotton fibers with an anionic derivatising agent, such as sulfamic acid, improves the fire retardency properties of the carpet.

Textile products treated in accordance with the present invention have shown to be successfully resistant to cross-staining by anionic dyes. In particular, textile articles treated in accordance with the present invention are capable of resisting being stained when placed in a bath containing a cotton swatch dyed with 2% DR-79 red dye or 2% DBL-80 blue dye, which are commonly used anionic dyes, washed at 120° F. according to AATCC IIA wash test specifications, rinsed clear and dried. Specifically, fabric swatches treated according to the present invention have been shown to have an AATCC gray scale rating of 4 to 5 after being contacted with the dyes as described above.

AATCC test method 61-1975, which includes reference to test IIA, is as follows:

1 Purposes and Scope 1.1 These accelerated laundering tests are designed for evaluating the washfastness of textiles which are expected to withstand frequent laundering. The color loss and abrasive action of five average hand, commercial, or home launderings with or without chlorine, are closely approximated by one 45-minute test. However, the staining effect produced by five average hand, commercial, or home launderings cannot always be predicted by the 45-minute test. Staining is a function of the ratio of colored fabrics in the wash load and other end use conditions which are not always predictable.

2. Principle 2.1 Specimens are laundered under the appropriate conditions of temperature, bleaching and abrasive action such that the desired loss of color is obtained in a conveniently short time. The abrasive action is accomplished by the use of throw, slide, and impact, together with the use of a low liquor ratio and an appropriate number of steel balls 3. Apparatus and Materials 3.1 Laundering-ometer or similar apparatus for rotating closed containers in a thermostatically controlled water bath at 42 rpm 3.2 Stainless steel cylinders, 9×20 cm (3½×8 in)

3.3 Adapter plates (for holding 9×20 cm (3½×8 in.) cylinders on Launder-Ometer shaft)

3.4 Stainless steel balls 3.5 Flatiron 3.6 Multifiber test fabric No. 10

3.7 Cotton fabric 80×80, bleached, desized 3.8 AATCC Standard Detergent WOB (without optical brightener)

3.9 AATCC Standard Detergent 124 (contains optical brightener)

3.10 Acetic acid, 28%

3.11 Water, distilled 3.12 Sodium hypochlorite 3.13 AATCC Chromatic Transference Scale 3.14 Gray Scale for color Change 3.15 Gray Scale for Staining 4. Test Specimens 4.1 The size of the specimens required for the test is as follows: 5×15 cm (2×6 in.)

4.2 One specimen is needed for each container 4.3 To determine staining multifiber test fabric should be used.

4.4 Prepare pieces with a 5 cm (2 in.) square of multifiber cloth sewed or stapled along one 5 cm (2 in.) edge of the test specimens and in contact with the face of the material. Attach so that each of the 6 fiber stripes along the 5 cm (2 in.) edge of the specimen. It is recommended that knitted fabrics be sewn or stapled at the four edges to equivalent size pieces of 80×80 bleached cotton fabric to avoid rolled edges and to assist in obtaining a uniform test result over the entire surface.

5. Procedure 5.1 Table I summarizes the conditions of the test.

TABLE I

| Test Conditions | | | | | | |
|---|---|---|---|---|---|---|
| Temp. | | Total Liquor Volume | % Detergent of Total | % Available Chlorine of Total | Steel Balls | Time in |
| F. | C. | in ml | Volume | Volume | (#) | Min. |
| 120 | 49 | 150 | 0.2 | None | 50 | 45 |

5.2 Adjust the Launder-Ometer to maintain the designated bath temperature. Prepare the required volume of wash liquor. Preheat this solution to the prescribed temperature.

5.3 The tests are run in 9×20 cm (3½×8 in.) stainless steel cylinders.

5.3.1 Place in the cylinder the amount of detergent solution as designated in Table 1.

5.3.2 Add the designated number of stainless steel balls to each container and clamp the cover. Fasten the 9×20 cm (3½×8 in.) containers horizontally in the adapters on the rotor of the Launder-Ometer in such a manner that when the containers rotate, the covers strike the wafer first. They are also arranged so that an equal number of containers is on each side of the shaft.

5.4 Start the rotor and run for not less then two minutes to preheat the containers.

5.5 Stop the rotor and with a row of containers in an upright position, unclamp the cover of one container, enter a well-crumpled test specimen into the solution and replace the cover, but do not clamp it. Repeat this operation until all the containers in the row have been loaded (cover clamping is delayed to allow equalization of pressure). Start the Launder-Ometer and run at 42 rpm for 45 minutes.

5.6 The rinsing, souring extraction, and drying methods are the same for all the tests. Stop the machine, remove the containers and empty the contents. Rinse each test specimen twice, in beakers, in fresh 100-ml baths of water at 40° C. (150° F.) for one-minute periods with occasional stirring or hand squeezing. Sour in 100 ml of a 0.014% solution of acetic acid (0.05 ml of 28% acetic acid per 100 ml of water) for one minute at 27° C. (80° F.). rinse again for one minute in 100 ml water at 27° C. (80° F.). Hydroextract or pass the test specimens between wringer rolls to remove excess moisture. Dry by pressing with an iron (135° C.–150° C.) (275°–300° F.) with the fabric uppermost and in contact with the face of the test specimen.

6. Interpretation of Results 6.1 The conditions in these tests give results which correlate with the results of five average home or commercial launderings. These are accelerated tests, and in obtaining the required degree of acceleration some of the conditions, such as temperature, were purposely exaggerated. These tests are satisfactory consumer end-use tests, and the correlation with average laundry practice is given in the following section on Evaluation.

7. Evaluation 7.1 This test is designated for evaluating the washfastness of fabrics that are expected to withstand repeated low-temperature machine washing in the home or in the commercial laundry. Specimens subjected to this test should show color damage similar to that produced by five commercial launderings at 38° C. (100° F.) or by five home machine launderings at medium or warm setting in the temperature range of 38° C. (100° F.).

8. Evaluation Method for Staining 8.1 Staining can be evaluated by means of the AATCC Chromatic Transference Scale or the Gray Scale for Staining. The means should be indicated when reporting the test results.

Class 5—negligible or no staining.

Class 4—staining equivalent to Row 4 on the AATCC Scale or Step 4 on the Staining Scale.

Class 3—staining equivalent to Row 3 on the AATCC Scale or Step 3 on the Staining Scale.

Class 2—staining equivalent to Row 2 on the AATCC Scale or Step 2 on the Staining Scale.

Class 1—staining equivalent to Row 1 on the AATCC Scale or Step 1 on the Staining Scale.

Besides being used to prevent cross-staining, it has been unexpectedly discovered that the present invention may also be used to facilitate the application of permanent press resins to cellulosic fibers. In this further embodiment of the present invention, magnesium is combined with sulfamate in order to provide a catalyst for the curing of permanent press resins such as dimethyl dihydroxy ethylene urea (referred to herein as "DMDHEU"). It is speculated that during the curing process, the sulfate esters (derived from the magnesium sulfamate) can also be reacted with the OH groups of the permanent press resins. The resins are then cross-linked to the cellulosic fibers in order to permanently render the fibers wrinkle resistant.

Because of the use of sulfamate in the application of the resins, the anionic character of the fibers is also increased. Thus, the fibers become both wrinkle-free and stain resistant.

In the past, catalysts such as $MgCl_2$, $AlCl_3$ $Zn(NO_3)_2$, and $ZnCl_2$ have been used as catalysts in the application of permanent press resins such as DMDHEU resins to cellulosic fibers. However, it has been found that these catalysts tend to somewhat hydrolyze the cellulosic fibers, thus weakening them and decreasing both their tear and tensile strengths. The use of magnesium sulfamate, however, appears to cause much less hydrolysis and thus produces cured fabrics with improved tear and tensile strength properties.

EXAMPLES

Several tests were performed on anionically treated cellulosic fibers and fabrics produced according to the present invention in order to demonstrate the fabrics' increased resistance to cross-staining by heavily dyed fabrics. Routine test methodology was employed in testing these fabrics and fibers, and data was collected in order to quantitatively illustrate the increased resistance to cross-staining that results from the anionic treatment of cellulosic fibers and fabrics.

Example 1

In this example, a wash test, the AATCC IIA Wash Test, was performed on several different samples of 100% bleached mercerized cotton fabric. Most of the samples were anionically treated in accordance with the present invention, while one sample was untreated. The wash test was first done using fabric dyed with 2% Direct Red (DR) 79 as a source of unfixed dye that would readily cross stain on to light-colored or white fabrics if those fabrics were untreated.

The fabric samples that had been treated according to the present invention with an anionic treatment process were padded with an aqueous solution, dried, cured, rinsed, and neutralized before being tested. The aqueous solution contained ammonium sulfamate and urea. The amounts of both the ammonium sulfamate and the urea were altered until the least amount of cross-staining occurred. The following results were obtained:

TABLE 1

AATCC - Grey Scale Ratings
Fabric 100% Bleached Merc. Cotton

| Undyed Portion of Test Fabric | Dyed Portion of Test Fabric: 2% Dir. Red 79 Stain on Undyed Cotton | Dyed Portion of Test Fabric: 2% Dir. Blue 80 Stain on Undyed Cotton |
|---|---|---|
| Original-No Treatment | 1 | 1 |
| 25 Gr/L ammonium sulfamate solution* 50 Gr/L Urea | 3 | 3 |
| 30 Gr/L ammonium sulfamate solution* 50 Gr/L Urea | 3–4 | 3–4 |
| 25 Gr/L ammonium sulfamate solution* No Urea | 2–3 | 2–3 |
| 30 Gr/L ammonium sulfamate solution* 75 Gr/L Urea | 4 | 4 |
| 40 Gr/L ammonium sulfamate solution* 50 Gr/L Urea | 4 | 4 |
| 40 Gr/L ammonium sulfamate solution* 75 Gr/L Urea | 4–5 | 4–5 |
| 1 = Heavy Stain | | |
| 5 = No Stain | | |

*Aqueous solution containing 47.0% ammonium sulfamate

As shown above, the untreated sample was heavily cross-stained to a dark pink color during the test. Fabrics treated according to the present invention, however, were stained much less. The fabric sample that exhibited the least amount of cross-staining was treated with 40 g/L of ammonium sulfamate solution and 75 g/L of urea. One fabric sample was tested after being treated with 25 g/L of ammonium sulfamate solution and no urea. This fabric sample showed significantly more cross-staining than did the sample treated with 25 g/L of ammonium sulfamate solution and 50 g/L of urea. This fabric sample also appeared slightly yellowed or discolored in spots indicating that hydrolysis of the cellulosic fibers may have taken place.

As shown in the table above, the same sequence of tests were performed using fabric dyed with 2% Direct Blue (DBl) 80 as the source of unfixed dye. Similar results were obtained. The fabric sample treated with 40 g/L of ammonium sulfamate solution and 75 g/L of urea exhibited the least amount of cross-staining. Thus, the results of the above example demonstrate both the importance of using urea as a catalyst in the treatment process and the excellent performance of the fabrics in resistance to cross-staining.

Example 2

In this example, the wash test used in Example 1, AATCC Wash Test Method 61-1994 Rectrin 2A, was performed on samples of 100% bleached unmercerized cotton fabric. Again, fabric dyed with 2% DR 79 and 2% DBl 80 were used as the sources of unfixed dye in order to facilitate possible cross-staining on to the fabric samples being tested. The following results were obtained:

TABLE 2

AATCC - Grey Scale Ratings
Fabric 100% Bleached Unmercerized Cotton

| Undyed Portion of Test Fabric | Dyed Portion of Test Fabric: 2% Dir. Red 79 Stain on Undyed Cotton | Dyed Portion of Test Fabric: 2% Dir. Blue 80 Stain on Undyed Cotton |
|---|---|---|
| Original-No Treatment | 2 | 2 |
| 25 Gr/L ammonium sulfamate solution* 50 Gr/L Urea | 5 | 5 |
| 30 Gr/L ammonium sulfamate solution* 50 Gr/L Urea | 5 | 5 |
| 25 Gr/L ammonium sulfamate solution* No Urea | 4 | 4–5 |

1 = Heavy Stain
5 = No Stain

*Aqueous solution containing 47.0% ammonium sulfamate

Similar to the previous example, fabric samples that were not treated by the anionic treatment process were tested and showed some cross-staining, while samples treated according to the present invention exhibited much less staining. The samples treated with 30 g/L of ammonium sulfamate solution and 50 g/L of urea showed absolutely no cross-staining when tested with the dyed fabrics. Other samples of bleached unmercerized cotton fabric that were treated with 25 g/L of ammonium sulfamate solution and no urea did exhibit some cross-staining.

These results further illustrate the benefits of using urea in the treatment process. In addition, since all cross-staining was eliminated with the use of just 30 g/L of ammonium sulfamate solution and 50 g/L of urea in this example, it is evident that unmercerized cotton fabrics require less negative charge than mercerized cotton because of the inherent lower receptivity to anionic dyes of unmercerized cotton. In the previous example, 40 g/L of ammonium sulfamate solution and 75 g/L of urea were required to produce a fabric with the least amount of cross-staining. However, the cross-staining was not completely eliminated as it was for the unmercerized samples. This result is fitting with anticipated results since mercerized fabrics have increased affinity for dyes (as well as increased luster). This increased affinity for dyes is attained through the mercerization process during which fabrics are immersed in cold basic solutions of sodium hydroxide and are later neutralized in acid.

Example 3

In this example, equal weights of a fabric dyed with 2% DR 79 and either an anionically treated or an untreated bleached mercerized cotton fabric were soaked together for 5 minutes at 100–120° F. at a 15:1 liquor ratio or ratio of weight of liquid used to weight of goods treated. The fabrics were then rinsed at room temperature and dried. These test conditions were established in order to resemble the pre-wash stage of an actual washing machine situation. The amounts of ammonium sulfamate and urea used were varied, and fabric samples were observed at several different processing stages including immediately after the rinsing and neutralization steps of the anionic treatment, after 1 pre-wash sitting as described above, and after 5 pre-wash sittings. A sample of untreated fabric exhibited some cross-staining in that it turned a light pink color. However, all of the treated fabric samples tested at each of the various observation stages and with each of the various amounts of ammonium sulfamate and urea showed absolutely no cross-staining. By looking at this example, it can be seen that under pre-wash conditions, the anionic treatment process successfully eliminates cross-staining of dark-colored dyes on to white or light-colored mercerized cotton fabrics.

Example 4

The same stain testing procedure used in Example 3 was employed in the present example; however, bleached unmercerized cotton fabric samples were tested. The sample of fabric untreated by the anionic treatment process exhibited just a small amount of cross-staining in that the fabric had an extremely faint pink tint. Yet, the anionically treated samples of unmercerized cotton fabric showed absolutely no cross-staining no matter the observation stage or the proportions of the reagents. Therefore, similar to Example 3, the anionic treatment process is seen to be successful in eliminating cross-staining on to unmercerized cotton fabrics under pre-wash conditions. Again, the unmercerized fabric samples proved to be more resistant to cross-staining than the mercerized fabric samples. This is consistent with the results found in Examples 1 and 2.

Example 5

In this example, tests were performed on fabric samples in order to demonstrate the permanence or durability of the anionic treatment. Anionically treated and untreated samples of 100% bleached mercerized cotton fabric were pre-washed 5 times in normal household detergent and under normal household laundering conditions with a hot washing period and a warm rinsing period. These samples were then subjected to AATCC 2A wash test conditions as stated in Example 2. The following results were obtained:

TABLE 3

AATCC - Grey Scale Ratings
Fabric 100% Bleached Merc. Cotton

| Undyed Portion of Test Fabric | Dyed Portion of Test Fabric: 2% Dir. Red 79 Stain on Undyed Cotton | Dyed Portion of Test Fabric: 2% Dir. Blue 80 Stain on Undyed Cotton |
|---|---|---|
| Original-No Treatment | 1 | 1 |
| 25 Gr/L ammonium sulfamate solution* 50 Gr/L Urea | 3 | 3 |
| 30 Gr/L ammonium sulfamate solution* 50 Gr/L Urea | 3–4 | 3–4 |
| 25 Gr/L ammonium sulfamate solution* No Urea | 2–3 | 2–3 |
| 30 Gr/L ammonium sulfamate solution* 75 Gr/L Urea | 4 | 4 |
| 40 Gr/L ammonium sulfamate solution* 50 Gr/L Urea | 4 | 4 |

TABLE 3-continued

| AATCC - Grey Scale Ratings Fabric 100% Bleached Merc. Cotton | | |
|---|---|---|
| | Dyed Portion of Test Fabric | |
| Undyed Portion of Test Fabric | 2% Dir. Red 79 Stain on Undyed Cotton | 2% Dir. Blue 80 Stain on Undyed Cotton |
| 40 Gr/L ammonium sulfamate solution* 75 Gr/L Urea 1 = Heavy Stain 5 = No Stain | 4 | 4–5 |

*Aqueous solution containing 47.0% ammonium sulfamate

The sample of mercerized fabric that had not been anionically treated exhibited significant cross-staining. Yet, the samples of fabric that had been treated with 40 g/L of ammonium sulfamate solution and 75 g/L of urea displayed the least amount of cross-staining. Furthermore, the samples treated with 25 g/L of ammonium sulfamate solution and no urea showed significant cross-staining as well as slight yellowing. Therefore, the value of using urea as a catalyst in the treatment process is again illustrated. In addition, the effects of the anionic treatment process are shown to be permanent as seen with the fabric samples whose resistance to cross-staining after 5 pre-washes was just as strong as it was prior to being pre-washed.

Example 6

The same procedures used for testing the durability and permanence of the anionic treatment process in Example 5 were employed in this example except that samples of 100% bleached unmercerized cotton fabric were tested. The following results were obtained:

TABLE 4

| AATCC - Grey Scale Ratings Fabric 100% Bleached Unmercerized Cotton | | |
|---|---|---|
| | Dyed Portion of Test Fabric | |
| Undyed Portion of Test Fabric | 2% Dir. Red 79 Stain on Undyed Cotton | 2% Dir. Blue 80 Stain on Undyed Cotton |
| Original-No Treatment | 2 | 2 |
| 25 Gr/L ammonium sulfamate solution* 50 Gr/L Urea | 5–4 | 5 |
| 30 Gr/L ammonium sulfamate solution* 50 Gr/L Urea | 5–4 | 5 |
| 25 Gr/L ammonium sulfamate solution* No Urea 1 = Heavy Stain 5 = No Stain | 4–5 | 4–5 |

*Aqueous solution containing 47.0% ammonium sulfamate

The fabric samples treated with 30 g/L of ammonium sulfamate solution and 50 g/L of urea exhibited absolutely no cross-staining. However, samples treated with 25 g/L ammonium sulfamate solution and no urea did show some cross-staining. Therefore, comparable to Example 5, the importance of using urea as a catalyst as well as the permanence and durability of the anionic treatment process are shown. These samples of unmercerized cotton fabric also proved to be more readily treated for cross stain resistance than the samples of mercerized cotton tested in Example 5.

Example 7

The tests in this example were performed in order to further determine the effects of varying the concentration of urea in catalyzing the anionic treatment process described in the present invention. Samples of 100% bleached mercerized cotton fabric were tested after being padded with the aqueous treatment solution, dried, and cured at 300° F. The source of unfixed dye used was fabric dyed with 2% DBl 80. The concentration of ammonium sulfamate solution (47.0% solution) incorporated into the aqueous treatment solution was held constant at 25 g/L while the concentration of urea was varied from 2.5 g/L up to 100 g/L. The following results were obtained:

TABLE 5

| AATCC - Grey Scale Ratings Fabric 100% Bleached Merc. Cotton | |
|---|---|
| Undyed Portion of Test Fabric | Dyed-Portion of Test Fabric 2% Dir. Blue 80 Stain on Undyed Cotton |
| 25 Gr/L ammonium sulfamate solution* 2.5 Gr/L Urea | 2–3 |
| 25 Gr/L ammonium sulfamate solution* 5 Gr/L Urea | 3 |
| 25 Gr/L ammonium sulfamate solution* 10 Gr/L Urea | 3 |
| 25 Gr/L ammonium sulfamate solution* 15 Gr/L Urea | 3 |
| 25 Gr/L ammonium sulfamate solution* 20 Gr/L Urea | 3 |
| 25 Gr/L ammonium sulfamate solution* 25 Gr/L Urea | 3 |
| 25 Gr/L ammonium sulfamate solution* 30 Gr/L Urea | 3–4 |
| 25 Gr/L ammonium sulfamate solution* 40 Gr/L Urea | 3–4 |
| 25 Gr/L ammonium sulfamate solution* 50 Gr/L Urea | 4 |
| 25 Gr/L ammonium sulfamate solution* 75 Gr/L Urea | 4–5 |
| 25 Gr/L ammonium sulfamate solution* 100 Gr/L Urea | 4–5 |
| Original - No Treatment 1 = Heavy Stain 5 = No Stain | 1 |

*Aqueous solution containing 47.0% ammonium sulfamate

The fabric sample treated with 75 g/L of urea (along with the 25 g/L of ammonium sulfamate solution) exhibited the least amount of cross-staining. This shows that using 100 g/L of urea in the treatment solution is above the level needed in this embodiment and that 75 g/L of urea is the optimum concentration for applying excellent cross stain resistance to this mercerized cotton fabrics.

Example 8

This example demonstrates the general nature of the concept that creating additional anionic groups on cellulose alters some of the basic characteristics of cotton fabric. The previous examples examined the effect on dye uptake. Here, the effect on one of the performance properties, smoothness (or resistance to laundry wrinkles) is investigated. Additionally, the anionic groups were generated by an alternate chemistry to the sulfamate that has been discussed.

Comparisons were made of fabrics that had been treated with chloroacetic acid to fabrics that had been treated with a standard cellulosic crosslinking chemistry which is composed of DMDHEU resin and catalyst. The treatment procedures of the solutions that were applied to the fabric are summarized in Table 6.

Included in Table 6 are the smoothness ratings that were determined by comparisons to the AATCC series of Three Dimensional Durable press Rating Replicas (used with AATCC standard test method 124). Under this type of rating system, rating 1 is the worst, the most wrinkled, and rating 5 is the best, or least wrinkled.

The fabric in all cases is 100% cotton bleached "80 square" cotton cut into 15 in. by 15 in. sections. In each run, the solutions were made at ambient temperature by adding the components to the water in the order shown in Table 6.

Run 1)

1) Pad at room temperature to a wet pick-up of 70%
2) Dry at 140° F.–160° F. for 2 minutes
3) Cure at 300° F. for 5 minutes
4) Wash and dry as per AATCC test method 124–1989
5) Evaluate smoothness as per AATCC test method 124

Run 2) (As per Procedure 1 except that step 3 is to cure for 3 minutes at 325° F.)

Run 3–Run 5) (as in Run 1)

TABLE 6

(Chemical compositions of the solutions used in the various runs. Amounts are in % on the weight of the fabric.)

| Chemical | Run 1 | Run 2 | Run 3 | Run 4 | Run 5 |
|---|---|---|---|---|---|
| sodium chloroacetate | 10 | — | 10 | 37 | 37 |
| sodium carbonate | 2 | — | 2 | 6.6 | 6.6 |
| Protocol CM* (DMDHEU) | — | 10 | — | — | — |
| Protowet CMS* (wetting agent) | — | 0.2 | 0.2 | — | 0.2 |
| Blue J Ultralux* (softener) | — | 6 | 6 | — | 6 |
| Marksoft HP* (softener) | — | 3 | 3 | — | 3 |
| Curite 5361* (softener) | — | 2.5 | — | — | — |
| Ratings: | | | | | |
| Washed and Tumble dried | 3.5 | 3.5 | 3.0 | 3.0 | 3.5 |
| Washed and Line-dried | 3.0 | 3.5 | — | — | — |
| Washed and Drip-dried | 3.5 | 3.0 | 3.0 | — | — |

(NO TREATMENT - 2)
*Registered trademark of Sybron Chemicals, Inc.

Based on the ratings recorded above, fabrics treated with the anionic agent alone were smoother, more free of wrinkles, than the untreated fabric and were nearly as smooth, after washing, as fabric treated with a conventional crosslinker.

Example 9

This example illustrates the possible utility of a metal salt of sulfamic acid as a catalyst to promote the crosslinking of cellulose by a DMDHEU resin.

Three sets of experiments were conducted.

In the first set, cotton fabrics were treated with a DMDHEU resin and a magnesium sulfamate solution. These fabrics were subsequently washed with a detergent solution which was deliberately contaminated with a red anionic dye. The treated fabric resisted staining. Removal of the resin by acid treatment and subsequent washing, again with dye in the wash, indicated that the resin itself, as well as the cellulose, is resistant to anionic staining.

In the second set of experiments, one group of fabrics was treated with DMDHEU resin and conventional catalyst and another group of fabrics was treated with DMDHEU resin and a magnesium sulfamate solution. In this second set, the fabrics were tested for their ability to recover from creasing.

Details of the application procedure are summarized below.

The amount of Resin and Catalyst (in % OWB) used are summarized in Table 7. Also included in Table 7 are the crease angles and resin fixations associated with various treatments. The crease angles indicate the resiliency imparted to the fabrics and were determined according to the AATCC standard method no. 66-1990. The higher the number, the more resistant the fabric is to wrinkling, and one can infer, the better the crosslinking. The resin fixations were calculated from the amount of nitrogen determined by Kjeldahl techniques on fabrics before and after washing. The nitrogen content of a fabric sample is directly related to the amount of resin that is applied and the % resin fixation is the percent resin that remains permanently bound to the fabric during washing.

Application procedure:

1) Prepare the finish bath by mixing the resin into 80° F.–90° F. water and diluting with water until the total amount of water has been added.
2) Add the catalyst to the solution after all the water is in.
3) Apply the finish solution to fabric be expression-nip techniques to a wet-pick-up of 75%.
4) Dry the fabric in a horizontal Benz oven for 2 minutes at 200° F.
5) Cure the fabric at 400° F. for 12 seconds.

TABLE 7

| Chemical | Amounts % OWB (On Weight Bath) | | | | | |
|---|---|---|---|---|---|---|
| Run No. | 5 | 6 | 7 | 8 | 9 | 10 |
| Protorez 6041 B* | 10 | 12 | — | — | — | — |
| Protorez 6041 B Base** | — | — | 10 | 10 | 12 | 12 |
| F1998G*** | — | — | 1.5 | 2.0 | 1.5 | 2.0 |
| Crease Angle (deg) | 265 | 270 | 266 | 261 | 283 | 286 |
| Nitrogen Fixation (%) | 89% | 96% | 90% | 70% | 97% | 82% |

*Combination of DMDHEU resin and conventional catalyst
**DMDHEU resin base used in Protorez 6041 B
***Magnesium sulfamate solution (52.24% water, 39.51% sulfamic acid, 8.25% magnesium oxide)

Comparing run 5 to run 7 and run 6 to run 9, we see a higher crease angle when the sulfamate catalyst is used. Also, it is evident that the difference in crease angles between the conventional and the sulfamate catalysts increases as the level of resin increases.

Comparing run 7 to run 8 and run 9 to run 10, we see that an increase in catalyst level results in a reduction in crease angle. This is to be expected. Cellulose can be hydrolyzed under acid conditions, and to increase the level of magnesium sulfamate is to increase the level of Lewis Acid.

In the third set of experiments one group of fabrics was treated with a conventional resin and a conventional catalyst and another group was treated with the same conventional resin but a magnesium sulfamate catalyst. The resulting anionic fabrics were tested to determine the effects of the catalysts on strength and dimensional stability.

The fabrics were treated according to the procedure outlined below and the compositions of the treating solutions, as well as the test results are summarized in Table 8.

Procedure:

Step 1) Set water temperature to 80° F.–90° F. and add resin

Step 2) Add Tanasoft (softener) and Protowet (wetting agent) and mix

Step 3) Add catalyst as the last ingredient and mix

Step 4) Apply to fabric by expression nip techniques to a wet-pick-up of about 61%

Step 5) Attach securely to frame to insure that the dimensions do not change in subsequent steps Step 6) Dry in Benz oven at 250° F. for 1.5 minutes Step 7) Cure in Benz oven at 325° F. for 1.5 minutes

TABLE 8

| | Bleached Only | 1 | 2 | 3 | 4 |
|---|---|---|---|---|---|
| Chemical (% OWB) | | | | | |
| Protocol CM* | — | 10% | 8% | 10% | — |
| Protowet CMS** | — | 0.5% | 0.5% | 0.5% | 0.5% |
| Tanasoft PTX*** | — | 2.0% | 2.0% | 2.0% | 2.0% |
| Curite 5361*** | — | 2.5% | — | — | — |
| F1998G | — | — | 2.0% | 2.5% | — |
| Test | | | | | |
| Tensile | (lbs) | (lbs) | (lbs) | (lbs) | (lbs) |
| Warp | 92.33 | 64.16 | 81.33 | 83.2 | 93 |
| Fill | 93.33 | 63.5 | 77.7 | 73.6 | 82 |
| Tear | (lbs) | (lbs) | (lbs) | (lbs) | (lbs) |
| Warp | 3.52 | 4.77 | 6.2 | 6.1 | 10.2 |
| Fill | 3.30 | 4.22 | 5.7 | 5.8 | 8.8 |
| Shrinkage | | | | | |
| Warp | 6% | 2.0% | 2.5% | 2.3% | — |
| Fill | 2.3% | 0.7% | 0.8% | 0.8% | — |
| Wet Crease Angle Warp Filling | 128° | 180° | 152° | 164° | 126° |
| Dry Crease Angle Warp Fill | 187° | 253° | 224° | 238° | 179° |
| Flex Abrasion Warp Fill | 181 Cycles | 303 Cycles | 894 Cycles | 834 Cycles | 1217 Cycles |

*Registered Trademark of Sybron Chemicals Conventional DMDHEU
**Registered Trademark of Sybron Chemicals, Inc.–Conventional Wetting Agent
***Registered Trademark of Sybron Chemicals, Inc. Conventional Textile Softener
****Registered Trademark of Sybron Chemicals, Inc. Conventional Buffered Crosslinking Catalyst
(All these tests are standard AATCC Test Methods)

The column headed "bleached only" is for reference only. It illustrates the state of an unfinished fabric. The experiments test the effect of the resin and catalyst combination only, so the primary control in this set is Run 4, which has all the components of the bath which are constant (the softener, the wetter and the amount of water) but it has no resin or catalyst.

Comparing Run 4 to Runs 1, 2, and 3, the effects of the resin are evident. There is a loss of tensile strength compared to Run 4, a loss in tear strength, an increase in the crease angles, an increase in the flex abrasion cycles and a decrease in shrinkage. All these changes are advantageous except the tensile and tear strength losses. One of the advantages of the sulfamate chemistry is that at equivalent degrees of curing, there is not as great a loss in tensile or tear strength when the acidity required for crosslinking comes from sulfamic acid or a salt thereof. Based on the crease angles of runs 1, 2 and 3, curing did occur in theses samples; but, comparing the tensile and tear strengths of runs 2 and 3 to run 1, it is evident that the sulfamate based catalyst allows a higher strength which means that the fabric is less damaged.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for making a textile product containing cotton fibers resistant to cross-staining during laundering, said process comprising the steps of:

contacting cotton fibers used to make said textile product with a solution containing a derivatising agent, said derivatising agent comprising sulfamic acid or a sulfamate, said derivatising agent being present in said solution at a concentration up to about 40 grams per liter, said solution further comprising urea at a concentration of from about 25 grams per liter to about 100 grams per liter; and heating said cotton fibers to a temperature sufficient for said derivatising agent to react with said cotton fibers said derivatised cotton fibers having an increased anionic charge for making the fibers more resistant to anionic coloring agents.

2. A process as defined in claim 1, wherein said derivatising agent comprises a sulfamate.

3. A process as defined in claim 2, wherein said sulfamate comprises a reaction product of a volatile amine and sulfamic acid.

4. A process as defined in claim 3, wherein said volatile amine comprises a material selected from the group consisting of ammonium, methyl amine, ethyl amine, and mixtures thereof.

5. A process as defined in claim 3, wherein said volatile amine comprises ammonia.

6. A process as defined in claim 1, further comprising the step of contacting said cotton fibers with a cationic softener, said cationic softener forming a charge attraction with said anionic cotton fibers.

7. A process as defined in claim 1, wherein said derivatising agent is present in said solution in an amount of at least 5 grams per liter.

8. A process as defined in claim 1, wherein said cotton fibers are contained within a fabric when contacted with said solution containing said derivatising agent, said fabric being pre-dyed.

9. A process as defined in claim 8, wherein said fabric is contained within a completed garment.

10. A process for making a garment containing cotton fibers resistant to being cross-stained with anionic coloring agents during laundering, said process comprising the steps of:

providing a yarn containing cotton fibers;

contacting said yarn with a solution containing an anionic derivatising agent, said derivatising agent comprising sulfamic acid or a sulfamate, said derivatising agent being present in said solution at a concentration up to about 40 grams per liter, said solution further comprising urea at a concentration of from about 25 grams per liter to about 100 grams per liter;

heating said yarn to a temperature sufficient for said derivatising agent to react with said cotton fibers, said derivatised cotton fibers having an increased anionic charge for making the fibers more resistant to anionic coloring agents; and forming said yarn into a garment.

11. A process as defined in claim 10, wherein said derivatising agent comprises a solution containing a sulfamate.

12. A process as defined in claim 10, wherein said solution further comprises a phosphorus compound, said phosphorus compound being present in said solution in an amount up to about 1 percent by weight.

13. A process as defined in claim 11, wherein said sulfamate comprises ammonium sulfamate.

14. A process as defined in claim 10, wherein said yarn is pre-dyed.

15. A process as defined in claim 10, wherein said derivatised yarn has a light color and wherein said derivatised yarn is combined with a yarn having a dark color when forming said garment.

16. A process as defined in claim 10, wherein said derivatised yarn comprises fill yarn contained in denim fabric.

17. A process as defined in claim 10, wherein said garment comprises a sock.

18. A process for preventing pocket liners from being cross-stained with anionic coloring agents during laundering, said process comprising the steps of:

contacting a pocket liner fabric with a solution containing an anionic derivatising agent, said derivatising agent comprising sulfamic acid or a sulfamate, said derivatising agent being present in said solution at a concentration up to about 40 grams per liter, said solution further comprising urea at a concentration of from about 25 grams per liter to about 100 grams per liter, said pocket liner fabric containing cotton fibers;

heating said pocket liner fabric to a temperature sufficient for said derivatising agent to react with said cotton fibers, said derivatised cotton fibers having an increased anionic charge for making the fibers more resistant to anionic coloring agents;

forming said pocket liner fabric into a pocket; and incorporating said pocket into a garment.

19. A process as defined in claim 18, wherein said derivatising agent comprises sulfamic acid.

20. A process as defined in claim 18, wherein said pocket liner fabric has a white color.

21. A process as defined in claim 18, wherein said derivatising agent attaches sulfate groups onto said cotton fibers.

22. A process as defined in claim 10, further comprising the step of contacting said cotton fibers with a cationic softener, said cationic softener forming a charge attraction with said anionic cotton fibers.

23. A process for preventing a textile product made from cellulosic fibers from being cross-stained with anionic coloring agents, said process comprising the steps of:

contacting said cellulosic fibers used to make said textile product with an aqueous solution containing urea at a concentration of up to about 100 grams per liter and a sulfating agent comprising sulfamic acid or a sulfamate, said sulfating agent being present in said solution at a concentration up to about 40 grams per liter;

drying said cellulosic fibers in order to remove substantially all of any moisture present on said fibers; and heating said cellulosic fibers to a temperature sufficient to sulfate said fibers, said sulfated fibers having an increased anionic charge for making the fibers more resistant to anionic coloring agents.

24. A process as defined in claim 23, wherein said urea is present in said aqueous solution at a concentration of from about 25 grams per liter to about 100 grams per liter and said sulfating agent is present in said aqueous solution at a concentration of from about 5 grams per liter to about 20 grams per liter.

25. A process as defined in claim 23, wherein said fibers comprise cotton fibers.

26. A process as defined in claim 23, wherein said fabric is heated to a temperature of from about 280° F. to about 325° F. in order to sulfate said fibers.

27. A process as defined in claim 22, wherein said softener comprises a fatty quaternary.

28. A process as defined in claim 22, wherein said softener comprises an amino siloxane.

29. A process as defined in claim 23, wherein said aqueous solution further comprises ammonium phosphate in an amount up to 1 percent by weight.

30. A process for making carpet materials containing cellulosic fibers resistant to staining by anionic coloring agents, said process comprising the steps of:

contacting a carpet material containing cellulosic fibers with an aqueous solution containing an anionic derivatising agent, said derivatising agent comprising sulfamic acid or a sulfamate, said derivatising agent being present in said solution at a concentration up to about 40 grams per liter, said solution further comprising urea at a concentration of from about 25 grams per liter to about 100 grams per liter; and heating said carpet material to a temperature sufficient to derivatise said cellulosic fibers, said derivatised fibers having an increased anionic charge for making the carpet material more resistant to anionic coloring agents.

31. A process as defined in claim 30, wherein said cellulosic fibers comprise cotton fibers.

32. A process as defined in claim 31, wherein said derivatising agent comprises ammonium sulfamate.

33. A process as defined in claim 23, further comprising the step of contacting said cotton fibers with a cationic softener, said cationic softener forming a charge attraction with said anionic cotton fibers.

34. A process as defined in claim 33, wherein said softener comprises a fatty quaternary.

35. A process as defined in claim 33, wherein said softener comprises an amino siloxane.

36. A process as defined in claim 6, wherein said softener comprises a fatty quaternary.

37. A process as defined in claim 6, wherein said softener comprises an amino siloxane.

38. A process as defined in claim 1, wherein said solution further comprises a phosphorus compound, said phosphorus compound being present in said solution in an amount up to about 1 percent by weight.

* * * * *